United States Patent [19]

Kjaer et al.

[11] 4,330,002

[45] May 18, 1982

[54] METHOD OF PRODUCING CHEROOTS AND SIMILAR TOBACCO ARTICLES AND AN APPARATUS FOR CARRYING OUT THIS METHOD

[75] Inventors: Ian Kjaer, Hadsund; Niels E. Mortensen, Gistrup, both of Denmark

[73] Assignee: Skandinavisk Tobakskompagni A/S, Søborg, Denmark

[21] Appl. No.: 158,130

[22] Filed: Jun. 10, 1980

[30] Foreign Application Priority Data

Jun. 19, 1979 [DK] Denmark ..... 2560/79

[51] Int. Cl.[3] ..... A24B 5/14; A24B 5/16; A24C 1/00

[52] U.S. Cl. ..... 131/365; 131/31; 131/36; 131/62; 131/77; 131/78; 131/79; 131/324

[58] Field of Search ..... 131/15 R, 147 R, 31, 131/36, 58, 62, 77, 78, 79, 123, 365, 315, 324

[56] References Cited

U.S. PATENT DOCUMENTS 651,615 6/1900 Samuel ..... 131/15 R 1,824,400 9/1931 Halstead ..... 131/15 R

*Primary Examiner*—V. Millin

*Attorney, Agent, or Firm*—Stevens, Davis, Miller & Mosher

[57] ABSTRACT

In the production of cheroots and similar tobacco articles with a wrapper made from natural tobacco relieved of central rib portions but containing portions of side ribs, the said ribs are flattened solely in the end flap of the wrapper.

3 Claims, 1 Drawing Figure

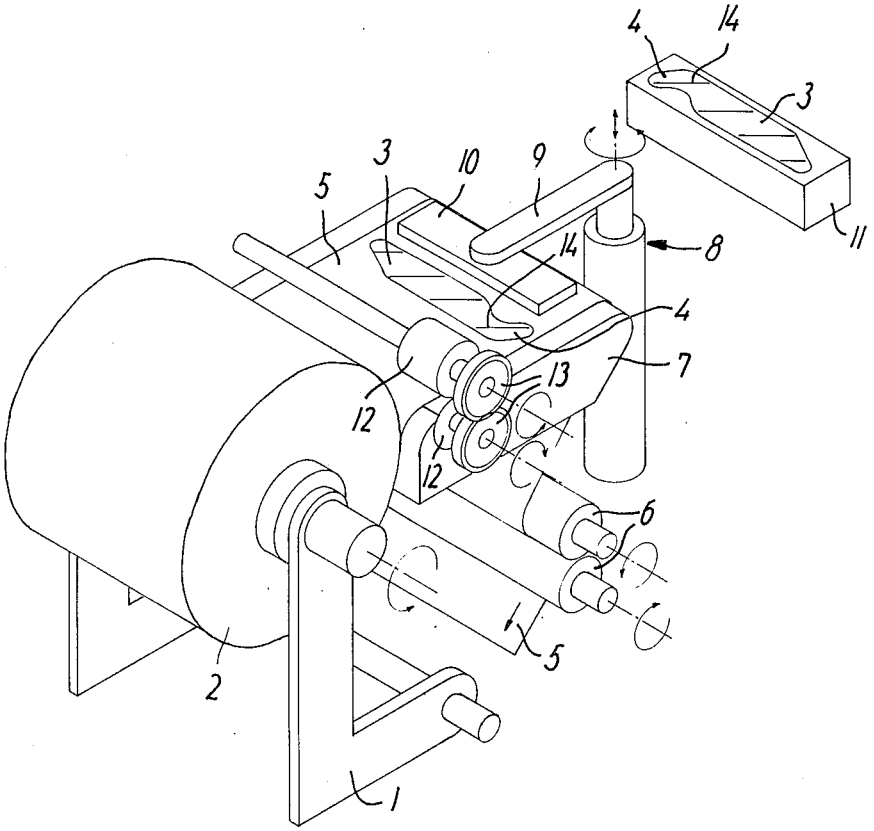
4
14
3
11
3
10
9
5
8
14
4
7
13
12
12
6
5
2
1

METHOD OF PRODUCING CHEROOTS AND SIMILAR TOBACCO ARTICLES AND AN APPARATUS FOR CARRYING OUT THIS METHOD

In the production of cheroots and similar tobacco articles having a wrapper of natural tobacco no parts of the vein or central rib of the tobacco leaf are tolerated in the wrapper. Therefore, the vein is either removed from the tobacco leaf prior to stamping or cutting out the wrapper, or care is taken to locate the stamping cuts so as not to interfere with the central rib. On the other hand, parts of the side ribs of the leaf are accepted in the wrapper, but by the stamping operation it is attempted to avoid side rib parts in the end flap of the wrapper, i.e. the portion that forms rather over the last turn of the wrapper when overrolled. This is due to the fact, firstly, that side rib parts in the end flap irritate the lips, in particular if the wrapper is rolled over with the wrong or lower side outward which is frequently preferred with a view to the appearance of the finished cheroot and, secondly, that such side rib parts might cause the tip of the cheroot to be less resistant to mechanical damage.

As far as singular stamping-out operations are concerned, the operator may have this in mind when locating the leaf on the stamp or cutting tool, but in this case a certain waste of the comparatively expensive wrapper material must often be allowed for, because the number of possible cuts per leaf is reduced. The same applies to multi-stamping, i.e. when simultaneously using two or more stamps, and these tools must furthermore be mutually adjustable in order to fulfil the purpose, whereby the machinery and wage costs are considerably increased. A further known possibility is the cutting up of tobacco leaves into shreds or strips with a width corresponding to the width of the wrappers to be used and, after defective portions having been cut away, gluing these strips together into a consecutive tape from which the wrappers are cut out so as to avoid side rib parts in the end flaps. These operations may be controlled automatically, but for this purpose extremely expensive machinery is required.

Also within other branches of the cigar production the ribs of tobacco leaves give rise to difficulties, and even the French patent specification No. 572,737 that was published more than 50 years ago includes a proposal for evading such difficulties in connection to this proposal whole tobacco leaves are moistened just sufficiently so that they can be manually spread out or smoothed and are then heated, for example to 100° C., with a view to soften the ribs, in particular the central rib, whereafter the leaves when still moist and hot are passed between squeeze rollers for flattening of the ribs. The said reference states that the entire tobacco leaf including its ribs but with the exception of its stem can then be utilized as cigar filler material.

A corresponding proposal, exclusive of the step of heating, has been presented in the still older German Pat. No. 149,491.

A similar flattening has presumably been attempted in the processing of wrappers subsequent to the removal of the central rib of the leaves, but this does not appear to be described in literature.

Recent tests have proved that a cut wrapper with side ribs that have been flattened by use of the technique known from the cited patent specifications may be acceptable even though it contains rib parts in its end flap, as these side rib parts have lost a considerable portion of their rigidity and thickness, but it has also been found that an efficient flattening causes a material weakening of the mechanical strength of the leaf, particularly in the immediate vicinity of the ribs. In some cases the flattening operation was followed by a virtual perforation, inasmuch as the mesophyll was locally torn off the ribs, while the leaves in other case apparently remained undamaged but, nevertheless, had been weakened so much that breakage or perforation showed up along the ribs in the subsequent overrolling operation.

Starting from the prior art discussed above, the invention relates to a method of manufacturing cheroots and similar tobacco articles comprising a wrapper cut from natural tobacco and including parts of the side ribs of the tobacco leaf. The invention aims at providing a method of this type and so improved that the side ribs by flattening and without undue weakening of the mechanical strength of the leaf may be deformed to such a degree that they are tolerable even in the end flap of the wrapper.

This is achieved according to the invention by subjecting the cut wrapper when moist to a rolling operation to flatten out the side ribs solely in the end flap of the wrapper.

The invention is based on the recognition that a certain weakening of the breakage strength of the wrapper may be tolerated precisely in the end flap because the end flap during the overrolling operation is subjected to a slighter tensile stress than the remaining portions of the wrapper. Thus, the flattening operation makes it possible to ensure that the side rib parts in the mouth piece end of the finished cheroot do not irritate, and still the tear strength of the wrapper is fully retained in those parts of the leaf that are subjected to the strongest stress during the overrolling operation.

Considerable savings as far as the production of wrappers is concerned are made possible by the rolling flat of the end flap of the wrapper, because the wrappers may be cut out without regard to a special or optimum location of the rib portions.

Among the objects of the endeavours of rationalization made within the field of cigar production is that of separating the wrapper cutting operation from the overrolling operation, viz. by winding the wrappers on a bobbin subsequent to the cutting operation instead of applying them immediately to the overrolling operation. By use of this technique the method according to the invention may appropriately be practised in the way that the cloth of the bobbin during the winding or unwinding thereof is used as a rolling base in connection with a driven or idling roller. This implies that the extra equipments needed to carry out the method are reduced to a minimum, since they only consist in a pair of driven or idling squeeze rollers between which the bobbin cloth passes during winding or unwinding the wrappers that are arranged so on the cloth that only their end flap is worked by the squeeze rollers.

The invention further relates to an apparatus for carrying out the method concerned, said apparatus being characterised in that it comprises a device for flattening out the side ribs of the wrapper exclusively in the end flap thereof and including a rotatable roller and an associated base. This base is suitably constituted by a bobbin cloth running over a roller.

An embodiment of such an apparatus is more specifically explained in the following with reference to the drawing, which in perspective shows the relevant parts of the apparatus.

The apparatus includes a framework, not shown, in which a bracket 1 is disposed to receive a bobbin 2 with wrappers 3 cut out in a previous operation and having an end flap 4. The bobbin cloth 5 is pulled off in the direction of the arrows by means of a pair of co-operating driving rollers 6, after which the cloth may be wound for renewed use. During the pulling-off operation the bobbin cloth 5 slides across a table 7 that may contain a suction box contributing to holding the wrappers 3 against the cloth till they reach a take-off position from which they are transferred to a roll-making machine by means of a transfer mechanism 8 having a suction mouth piece 10 mounted on a pivot arm 9. The said roll-making machine is simply symbolized by a bloc 11 on the drawing. As indicated by the arrows, the pivot arm 9 and with it also the suction mouth piece 10 may be subjected to a vertical movement of displacement as well as to a movement of rotation, said movements being supposed to be conventionally coordinated with the advance of the bobbin cloth 5.

The bobbin cloth 5 and the wrappers 3 lying on it enter the table 5 via a pair of short rollers 12 having a hard surface, for instance steel rollers, and provided with gear wheels 13 to secure the same circumferential velocity of both rollers. The end flaps 4 of the wrappers 3 are subjected to a rolling operation between said rollers 12 with the purpose of flattening the occurring side rib portion 14.

We claim:

1. An apparatus for preparing a wrapper for cheroots and similar tobacco articles, said wrapper having end flaps and being cut out from natural tobacco leaf and having parts of the side rib of the leaf therein, said apparatus comprising a side rib flattening means to flatten a moist cutout wrapper such that the side ribs are flattened exclusively in the end flap of the wrapper, said side rib flattening means comprising a rotatable roller and an associated base.

2. An apparatus according to claim 1, wherein the base is constituted by a bobbin cloth running over a roller.

3. A method of manufacturing cheroots and similar tobacco articles comprising the steps of and cutting a moist wrapper from natural tobacco, said moist wrapper including parts of the side ribs of a tobacco leaf, winding said moist wrapper on a bobbin, and flattening the side ribs of said moist wrapper solely in the end flap of the wrapper, said flattening step comprising rolling the end flap of the wrapper between a rotatable roller and a cloth of said bobbin.

* * * * *